US012678010B2

(12) United States Patent
Hachtmann et al.

(10) Patent No.: US 12,678,010 B2
(45) Date of Patent: Jul. 14, 2026

(54) FLOOR CLEANING DEVICE WITH EXHAUST FILTRATION

(71) Applicant: Better Cleaning Systems, Inc., Madera, CA (US)

(72) Inventors: William R. Hachtmann, Oakhurst, CA (US); Jeremy N. Wheeler, Fresno, CA (US); Laura L. Wheeler, Fresno, CA (US)

(73) Assignee: Better Cleaning Systems, Inc., Madera, CA (US)

( * ) Notice: Subject to any disclaimer, the term of this patent is extended or adjusted under 35 U.S.C. 154(b) by 524 days.

(21) Appl. No.: 18/134,778

(22) Filed: Apr. 14, 2023

(65) Prior Publication Data

US 2023/0329509 A1 Oct. 19, 2023

Related U.S. Application Data

(60) Provisional application No. 63/331,478, filed on Apr. 15, 2022.

(51) Int. Cl.
*A47L 11/40* (2006.01)
*A47L 11/30* (2006.01)

(52) U.S. Cl.
CPC ..... *A47L 11/4027* (2013.01); *A47L 11/30* (2013.01)

(58) Field of Classification Search
CPC .... A47L 11/4027; A47L 11/30; A47L 9/1409; A47L 11/4083
See application file for complete search history.

(56) References Cited

U.S. PATENT DOCUMENTS 2,781,103 A * 2/1957 Gerber ..... A47L 5/365 55/378
5,237,719 A * 8/1993 Dwyer, Jr. ..... A47L 11/4083 15/353
5,685,894 A * 11/1997 Bowerman ..... A47L 9/325 55/501
10,368,710 B1 * 8/2019 Robinson ..... A47L 11/00
2019/0117030 A1 * 4/2019 Kette ..... A47L 9/12
2019/0298127 A1 * 10/2019 Hu ..... A47L 9/1463

* cited by examiner

*Primary Examiner* — Andrew A Horton
(74) *Attorney, Agent, or Firm* — Aaron T. Borrowman; YK LAW LLP

(57) ABSTRACT

A floor cleaning device includes a floor cleaning member, such as a manual wand, having a cleaning solution emitter that emits cleaning solution onto a floor surface. A vacuum generator creates a vacuum so that debris and dirty cleaning solution is suctioned by the floor cleaning member. A filter assembly filters exhaust air of the vacuum generator.

20 Claims, 8 Drawing Sheets

FLOOR CLEANING DEVICE WITH EXHAUST FILTRATION

RELATED APPLICATIONS

This application claims the benefit of U.S. Provisional Application No. 63/331,478, filed on Apr. 15, 2022.

FIELD OF THE INVENTION

The present invention generally relates to floor cleaning and remediation. More particularly, the present invention resides in a floor cleaning device having filtered exhaust.

BACKGROUND OF THE INVENTION

There exist many different types of floor cleaning machines and devices. These include carpet cleaning machines, sometimes referred to as carpet extractors, that have a cleaning solution tank and a vacuum recovery tank. The cleaning solution is typically pressurized by an internal pump and leaves the machine from a solution outlet, typically associated with a cleaning wand. The wand sprays the cleaning solution on the carpet or other surface to be cleaned and the vacuum head of the wand extracts the now dirty solution off of the surface being cleaned. A vacuum hose that is connected to the wand is connected to a vacuum inlet of a tank of the machine. A vacuum pump or blower inside the machine creates the vacuum in the tank and exhausts air in the process.

Typically, the exhausted air is untreated. Thus, air from the debris tank and/or air from the floor or room is violently expelled from an exhaust outlet of the cleaning machine. Thus, dirty air is essentially pumped into the room, which can be breathed by the operator of the cleaning machine, spread contaminants to other floor areas or even other surfaces within the room. This is particularly problematic when the contaminants comprise bodily fluids, mold, bacteria, viruses or potentially other hazardous materials.

In the past, if the air needed to be exhausted from the room in which the floor was being cleaned due to contaminants, a large vacuum hose was connected to the vacuum outlet and the other end of the hose was placed outside of the room. This was inconvenient and time consuming. Moreover, extending the exhaust hose from one room in a building to another merely resulted in the contaminants in the air being emitted in another room of the building. Oftentimes, the exhaust hose was insufficiently long to extend outside of the building.

Accordingly, there is a continuing need to treat the air exhausted from the cleaning machine to avoid further contamination, protect operators of the cleaning machine and other individuals in the room or building. The present invention fulfills these needs, and provides other related advantages.

SUMMARY OF THE INVENTION

The present invention resides in a floor cleaning device in which the exhausted air is filtered. The floor cleaning device generally comprises a floor cleaning member having a cleaning solution emitter for emitting cleaning solution onto a floor. The floor cleaning member has an inlet through which debris and dirty cleaning solution is suctioned. The floor cleaning member may comprise a manually operated wand.

A cleaning solution tank is fluidly coupled to the cleaning solution emitter of the floor cleaning member. For example, a cleaning solution hose may extend from the cleaning solution tank to the cleaning solution emitter of the wand. A pump may be used to pump cleaning solution from the cleaning solution tank to the cleaning solution emitter of the floor cleaning member.

A debris tank is fluidly coupled to the inlet of the floor cleaning member for receiving debris and dirty cleaning solution therein. For example, a vacuum hose may extend from the debris tank to the wand.

A vacuum generator creates a vacuum in the debris tank for creating the suction at the floor cleaning member inlet. A filter assembly is disposed between the vacuum generator and an exhaust air outlet that filters exhaust air of the vacuum generator.

The filter assembly includes an air filter that filters objects of less than a micron or larger in size. The filter may comprise an HEPA or HEPA-like filter. The filter may be disposed within a chamber of an enclosed box of the filter assembly, between the inlet and outlet thereof. The box may include a lid and a base with a gasket therebetween to create an airtight seal. Straps may extend between the lid and the base to compressively hold the lid onto the base. At least one retainer plate may be disposed between the lid and the filter to compressively hold the filter in place. A sealing plate may be disposed between the filter and the box that forms an airtight seal therebetween.

The floor cleaning device may include a wheeled base, enabling manual movement of the floor cleaning device from one floor area to another.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a floor cleaning device, generally referred to by the reference number 100. As will be more fully explained herein, the exhaust generated from the floor cleaning device 100 is filtered so as to prevent the spread of airborne contaminants and protect the workers or other occupants of the room or building being cleaned.

Figure 1:
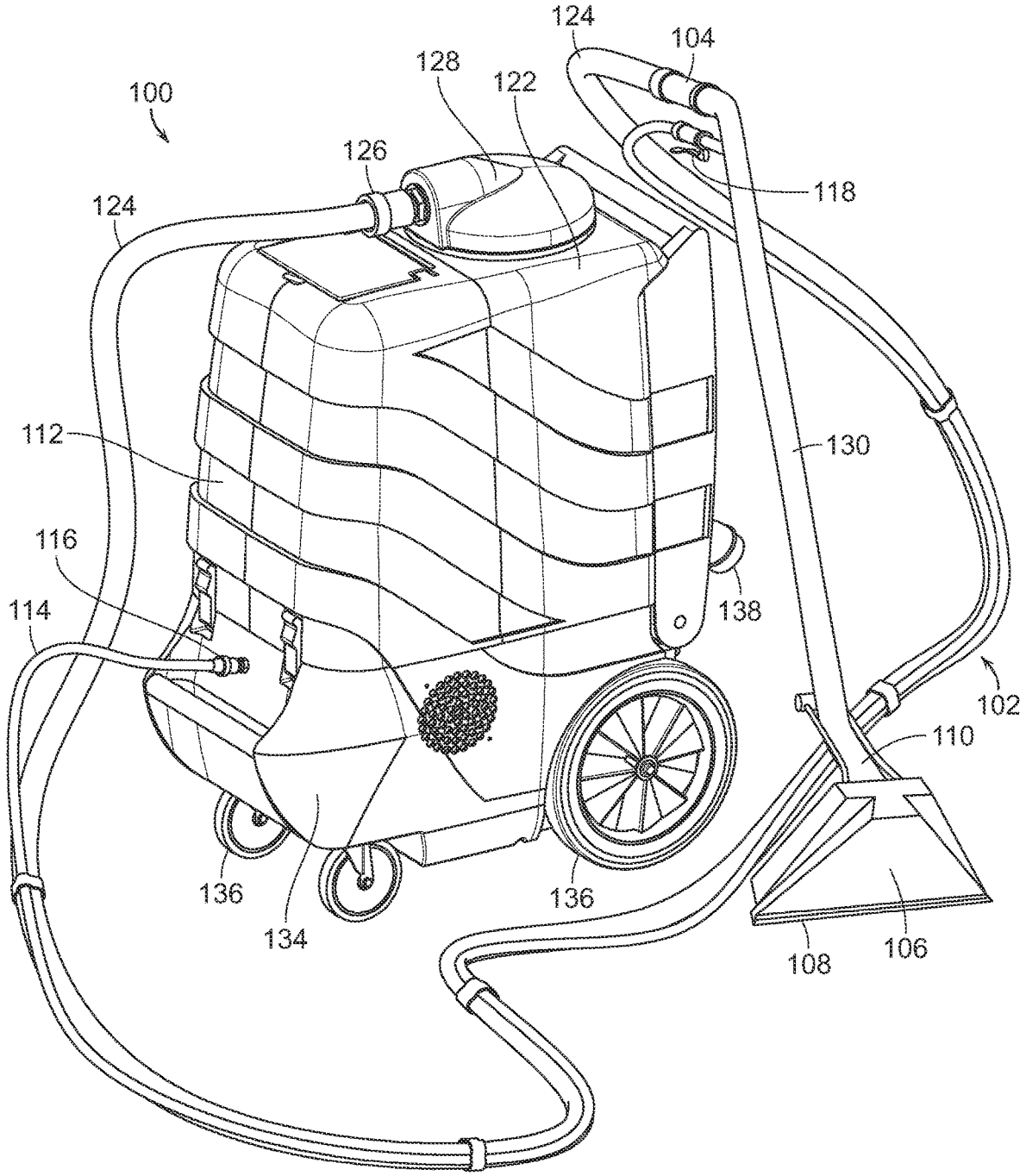
FIG. 1 is a front perspective view of a floor cleaning device embodying the present invention.

With reference now to FIG. 1, an exemplary floor cleaning device 100 embodying the present invention is shown. The floor cleaning device 100 includes a floor cleaning member 102, which may comprise a manually operated wand, as shown. The wand 104 has a handle section 104 which extends to a vacuum head 106 defining an inlet 108 into which dirt, debris, dirty cleaning solution, or other fluids is suctioned. The cleaning head 106 also includes a cleaning solution emitter 110, typically in the form of spray jets, which emits cleaning solution therefrom.

Figure 2:
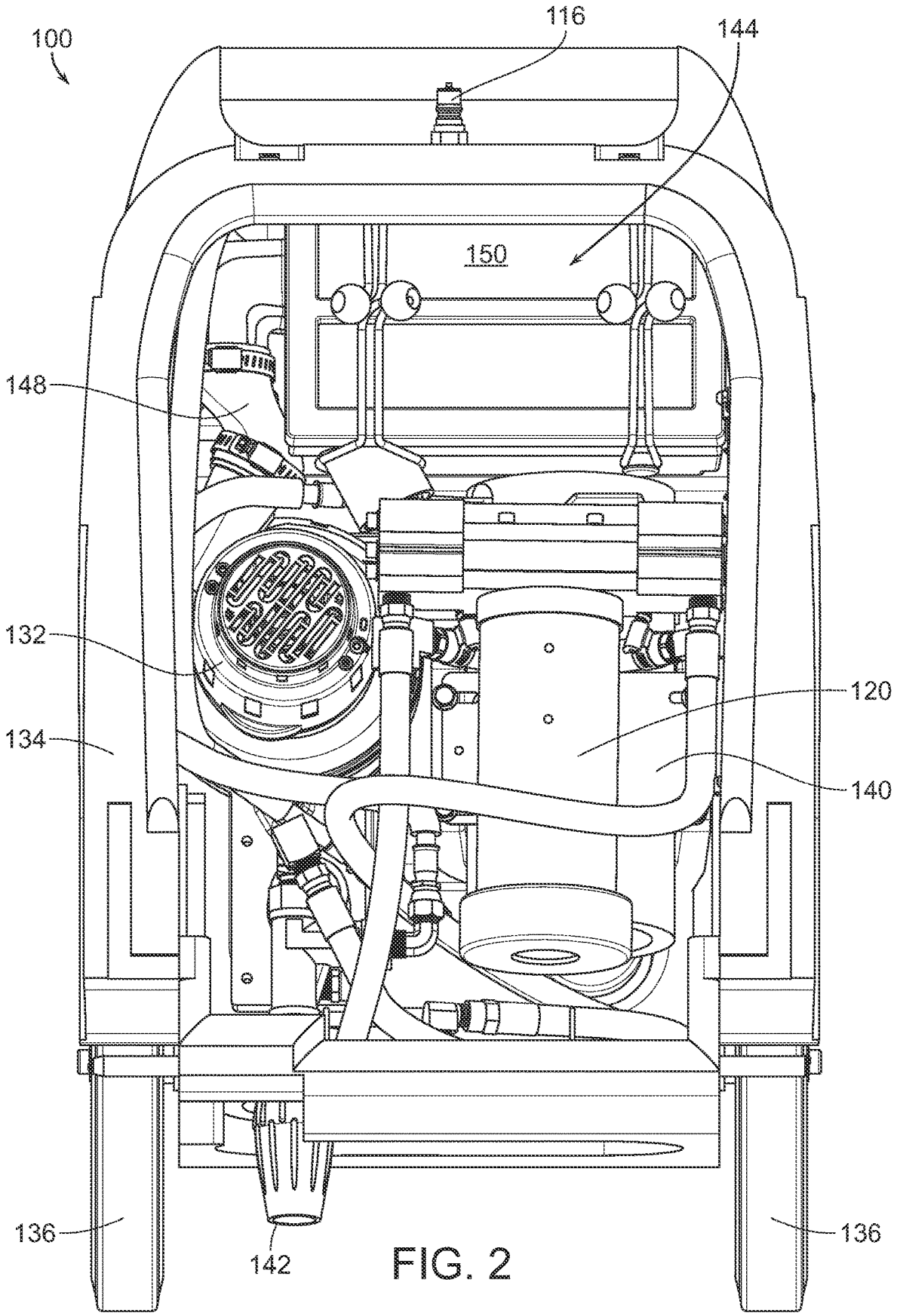
FIG. 2 is a top view of the floor cleaning device of FIG. 1, with the cleaning solution and debris tanks removed.

A cleaning solution tank 112 is fluidly coupled to the cleaning solution emitter 110 of the floor cleaning member 102. This may be, typically, by means of a cleaning solution hose 114 which extends from a solution outlet 116 of the cleaning solution tank 112 to the emitter 110. A trigger 118 or the like is typically positioned near the handle 104 such that the user can open a switch or valve to enable the cleaning solution from the cleaning tank 112 to pass through to the cleaning solution emitters 110, typically associated with the cleaning vacuum head 106, such that cleaning solution is sprayed onto the carpet or other floor surface. A cleaning solution pump 120, as illustrated in FIG. 2, serves to pump the cleaning solution from tank 112 to cleaning solution emitters 110. The cleaning solution pump 120 may directly pump the cleaning solution from tank 112 to the emitters 110, or pressurize the cleaning solution tank 112 so that the cleaning solution emitted therefrom is under pressure.

With continuing reference to FIGS. 1 and 2, a debris tank 122 is fluidly coupled to the inlet 108 of the vacuum head 106, such as by means of a vacuum hose 124 attached to an inlet 126 of a vacuum lid 128 operably connected to the debris tank 122. A hollow pipe 130, which may form part of the handle 104, of the wand 102 enables dirty cleaning solution, dirt, and other fluid and/or debris to be suctioned from the inlet 108 through the hollow pipe handle 130 to hose 124 and into the debris recovery tank 122. A vacuum generator 132, such as a vacuum motor or blower, inside of the device, as illustrated in FIG. 2, creates a vacuum in the debris tank 122, causing the suction through the hose 124 and inlet 108 of the vacuum head 106.

In operation, typically a user will position the vacuum head 106 of the floor cleaning member or wand 102 over an area of carpet or other flooring material to be cleaned and pull trigger 118 to emit cleaning solution onto the floor surface. The emitters are behind the vacuum head 106 and suction inlet 108, such that cleaning solution is emitted onto the floor surface first and as the vacuum head 106 and wand 102 are pulled toward the user the dirty cleaning solution is suctioned through inlet 108, through hollow pipe 130, through hose 124 and into the debris tank 122. This process is repeated until the entire area or floor surface is cleaned. Preferably, the device 100 has a base 134 with wheels 136, such that the device 100 can be manually moved from one floor area to another floor area by the operator when cleaning the carpet or other floor surface within the room or building.

Figure 3:
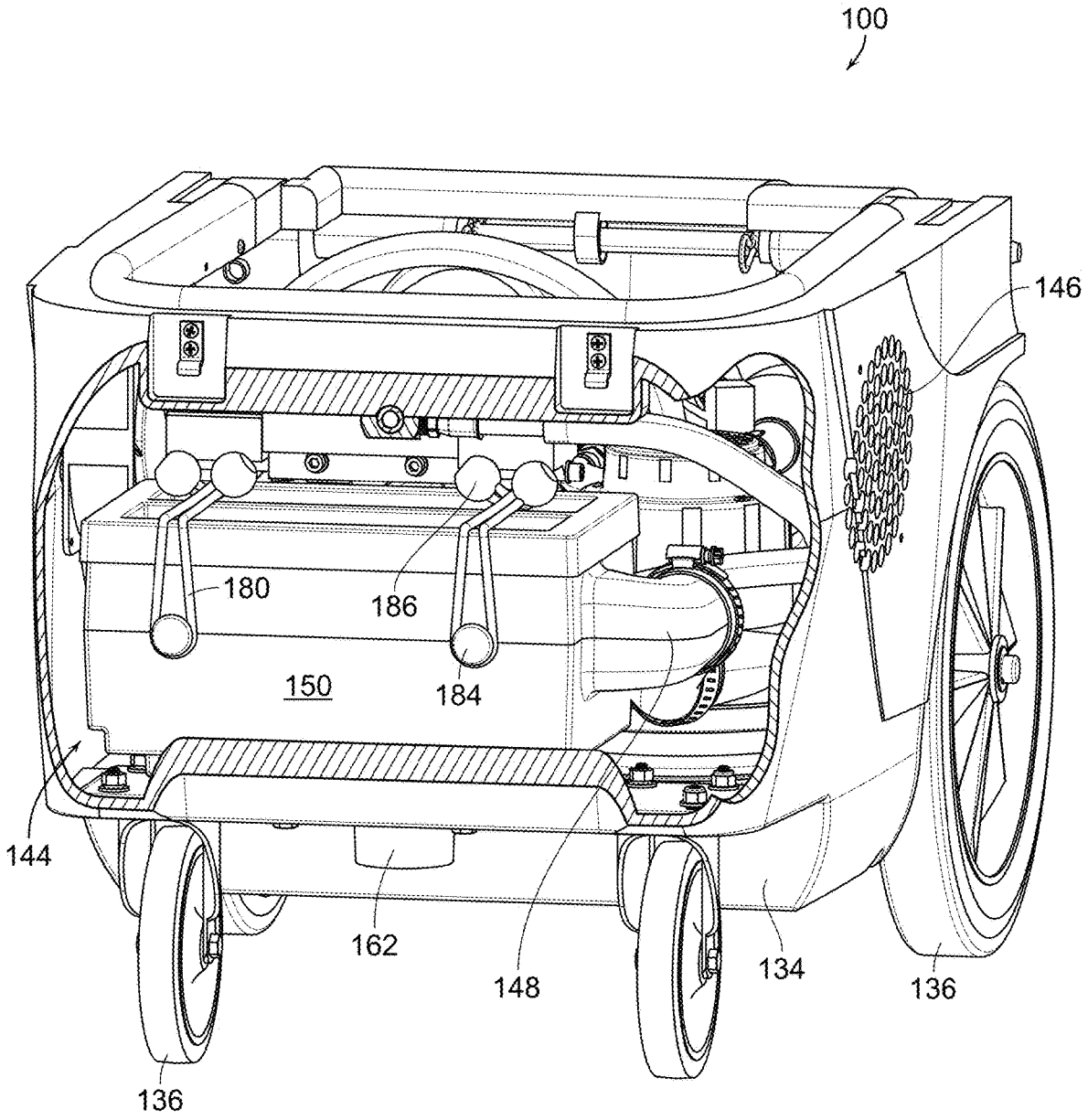
FIG. 3 is a partially cut away front view of the floor cleaning device of FIG. 2.
Figure 4:
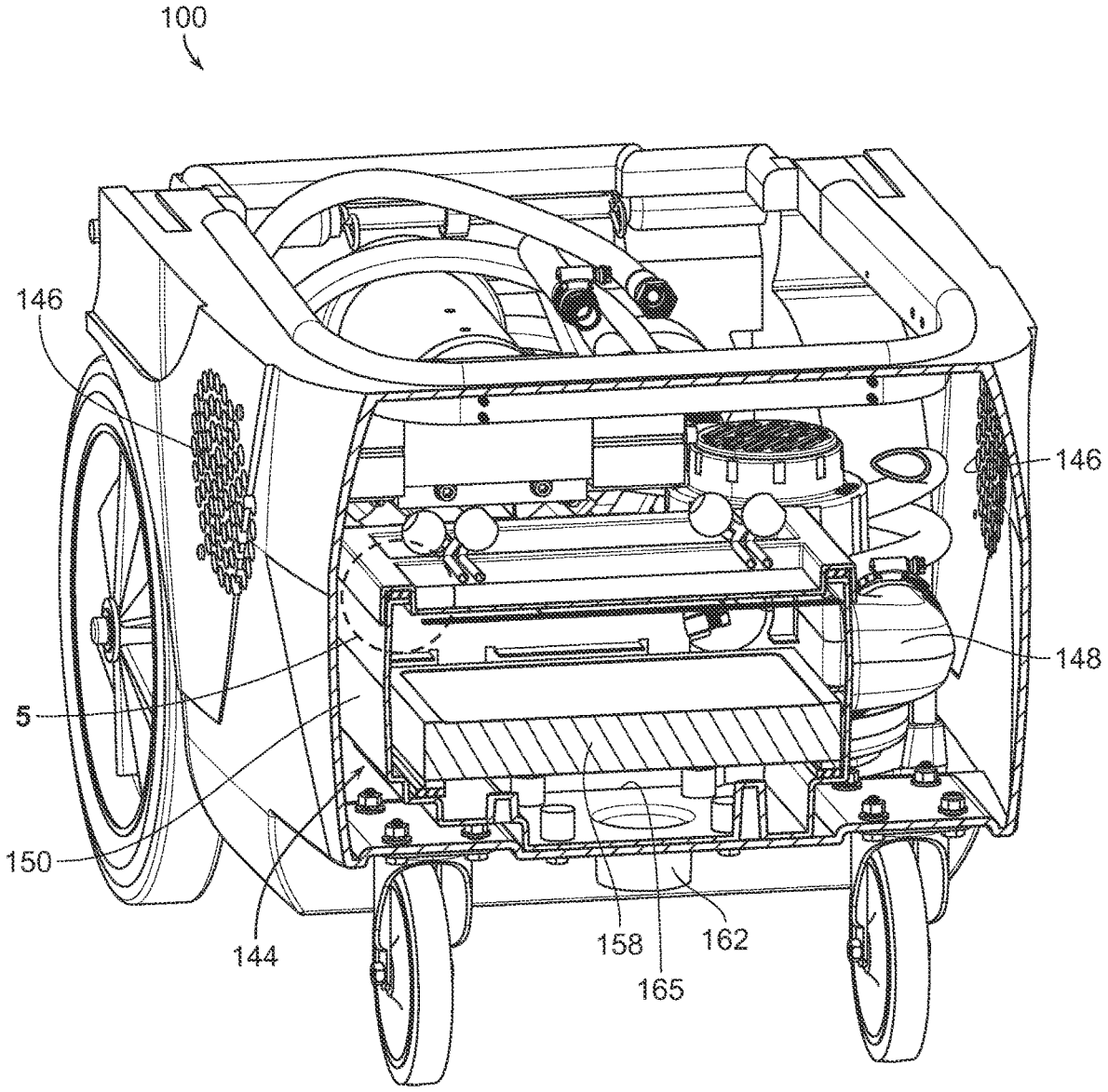
FIG. 4 is a partially sectioned and perspective view similar to FIG. 3, illustrating components of a filter assembly, used in accordance with the present invention.
Figure 5:
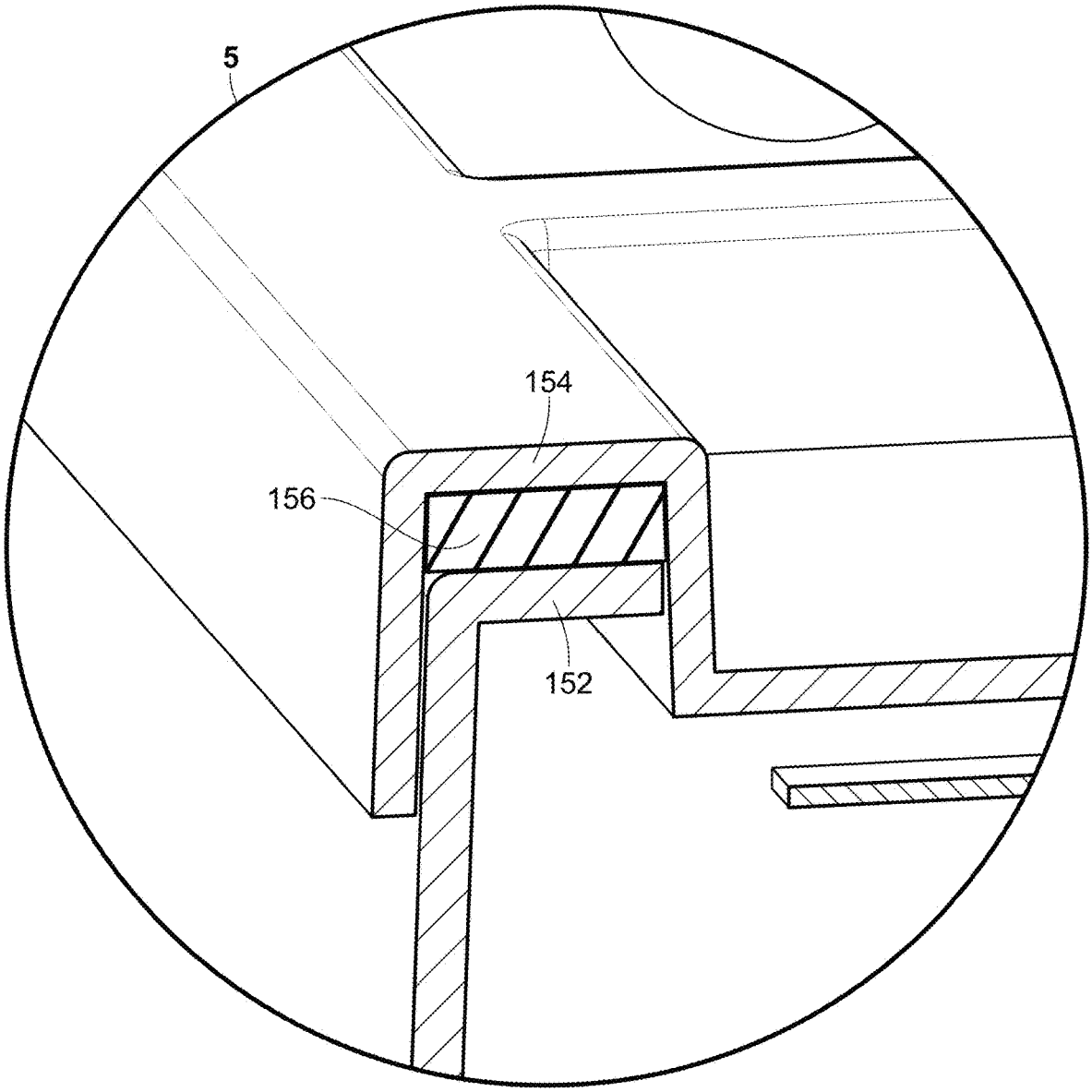
FIG. 5 is an enlarged cross-sectional view of area "5" of FIG. 4.

The cleaning solution tank 112 and/or the debris recovery tank 122 may be removed from the base 134, as illustrated in FIGS. 2-4. This may be, for example, by unlatching one or more of the tanks 112 and/or 122 and pivoting them away from the base 134 so as to gain access to the components therein. The debris recovery tank 122 may have a drain 138 at a lower end thereof for draining the contents of the debris recovery tank as desired.

With reference now to FIGS. 2-4, various components of the floor cleaning device 100 embodying the present invention are shown with the cleaning solution tank 112 and debris recovery tank 122 removed from the base 134. In FIG. 2, one can see the cleaning solution pump 120. There may also be included a cleaning solution heater 140. There is also the vacuum generator device 132, such as a vacuum motor or vacuum blower or the like. There are also various hoses and tubes which extend from these components to the cleaning solution tank 112, debris recovery tank 122, and other components for creating a positive or negative pressure, depending upon whether a positive pressure is desired for emission of the cleaning solution or a negative pressure for suctioning the dirt, dirty cleaning solution and the like from the floor surface. A pressure adjustment valve 142 may be used by the operator in order to adjust the pressure, as deemed desirable or necessary.

What is also shown in FIGS. 2-4 is a filter assembly 144 used for filtering the exhaust generated by the vacuum generator 132 during its operation. Vents 146 may be formed in the cover of the base 134 so that ambient air may flow in and out of the cleaning device 100. However, the vacuum generator 132 will typically draw air from within the debris recovery tank 122, so as to create a negative pressure therein. Alternatively, or additionally, a negatives pressure is created in the vacuum hose 124 such that a suction is created at the inlet 108 of the vacuum head 106 for suctioning of dirty cleaning solution, dirt, debris, etc. During the operation of the vacuum generator 132, exhaust air is created. Instead of exhausting this air into the room, as is currently done, the present invention couples an exhaust hose 148 to the filter assembly 144, preferably in a sealed manner, such that the exhausted air is filtered before being released into the room or other surroundings of the floor cleaning device 100.

Figure 6:
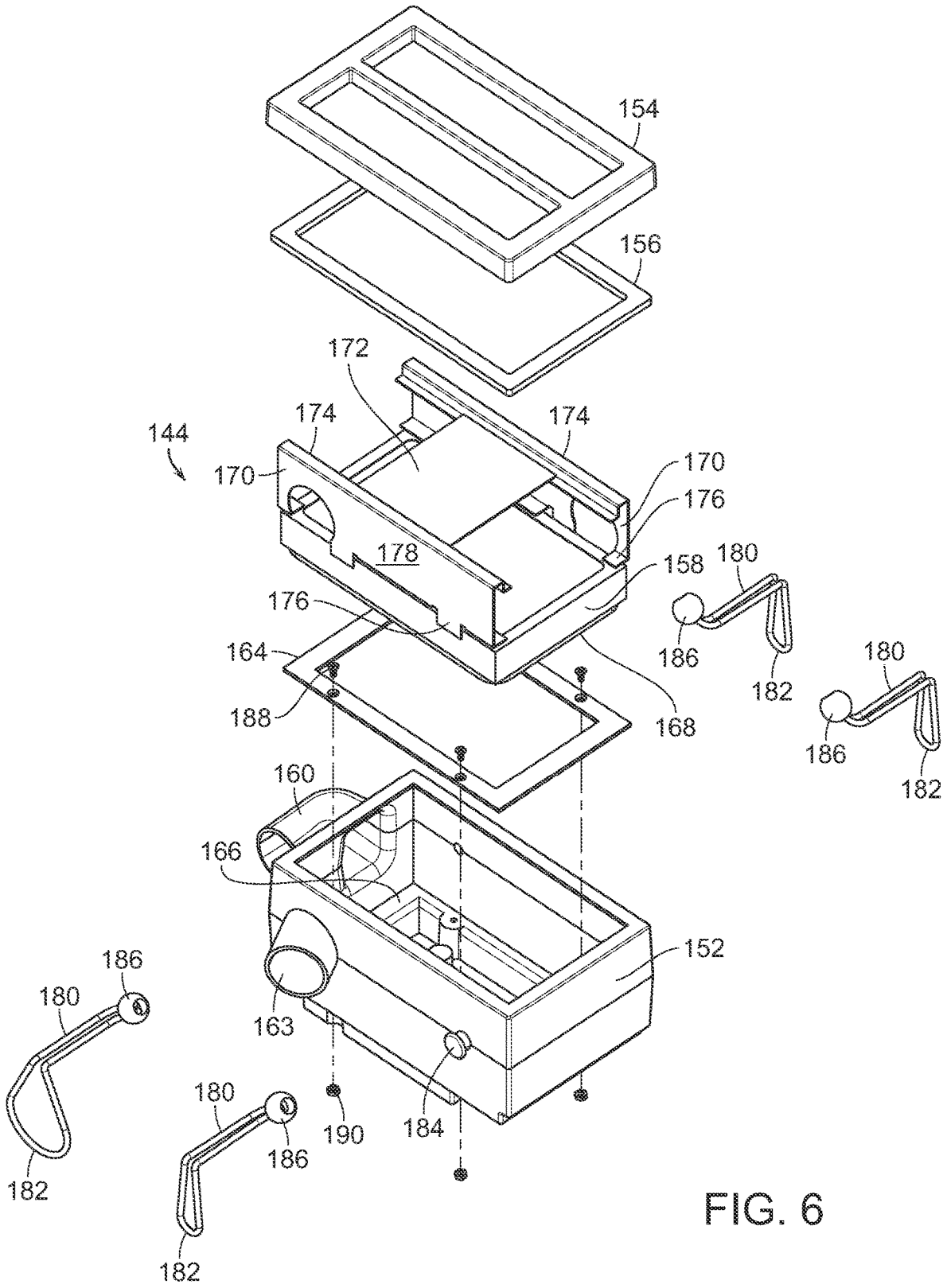
FIG. 6 is an exploded perspective view of a filter assembly, used in accordance with the present invention.

With reference now to FIG. 6, the filter assembly 144 comprises an enclosed box 150 comprised of a base 152 and a lid 154, and preferably a gasket or seal 156 disposed therebetween to create an airtight seal. A filter 158 is disposed within the box 150 between the exhaust inlet 160 and an exhaust outlet 162. The filter 158 is capable of filtering biohazardous materials, including biological tissue, biological fluid, bacteria, mold, and the like. The filter 158 is capable of filtering objects of less than a micron or larger in size from the exhaust air before it is expelled out the outlet 162. Preferably, the filter comprises a HEPA or HEPA-like or type filter. The filter may comprise a high-efficiency particulate air or high-efficiency particulate absorbing or arrestance filter. Such filters remove at least 99.95% of particles whose diameters are equal to or greater than 0.3 micrometers, and as such captures or filters pollen, dirt, dust, moisture, bacteria, and even viruses and submicron liquid aerosols.

The filter 158 is disposed within a chamber of the box 150 of the filter assembly 144 so as to filter such particles. In order to create an airtight seal, a sealing plate 164 is disposed between the filter 158 and the base 152 of the box 150. More particularly, the sealing plate 164 is placed upon a ledge 166 and a fastener, such as the illustrated bolts and nuts 188 and 190, fasten the sealing plate 164 to the base 152 of the box 150. A gasket 168 of the filter 158 contacts the sealing plate 164, creating an airtight fit therebetween. A bead of silicone or the like may be placed between the box ledge 166 and the sealing plate 164 to further provide an airtight seal.

In some embodiments of the invention, a second vacuum generator may be provided. This may be desirable in some instances where additional suction at the floor cleaning member is desired. In such case, as illustrated in FIG. 6, a second vacuum exhaust inlet 163 may be provided in the filter assembly above the filter within box 150.

With reference again to FIG. 4, it can be seen that the filter 158 is disposed within an internal chamber of the filter box 150. In a particularly preferred embodiment, as illustrated, there is a lower chamber 165 below the filter 158. This lower chamber 165 preferably has an upper area or total volume sufficient to enable the exhaust air to enter in through the filter 158 and collect within the chamber 165 below the air filter 158, before being funneled to the exhaust outlet 162.

With reference again to FIG. 6, at least one, and preferably two spaced apart, retainer plates 170 are disposed between the lid 154 and the filter 158. A separator plate 172 may extend between the two retainer plates 170 to hold them in position. The separator plate 172, which may lie within a groove or a step formed in the retainer plates 170, keep the retainer plates 170 properly positioned vertically and properly spaced from one another. The bottom surface of the lid 154 contacts an upper surface or ledge 174 of each retainer plate, pushing the retainer plate downwardly. The retainer plates include flanges 176 which extend inwardly and contact an upper surface of the filter 158, so as to compressively engage the filter 158. The main body portion 178 of the retainer plates 170, however, typically resides between an interior wall of the base 152 of the box and the filter 158. The two retainer plates 170 press down on the filter 158 by means of the retainer plate flanges 176 as the lid 154 is attached to the base 152 of the box. The body portions 178 of the retainer plates extend down between the filter and the filter box 150, ensuring that they press straight down upon the filter 158.

Figure 7:
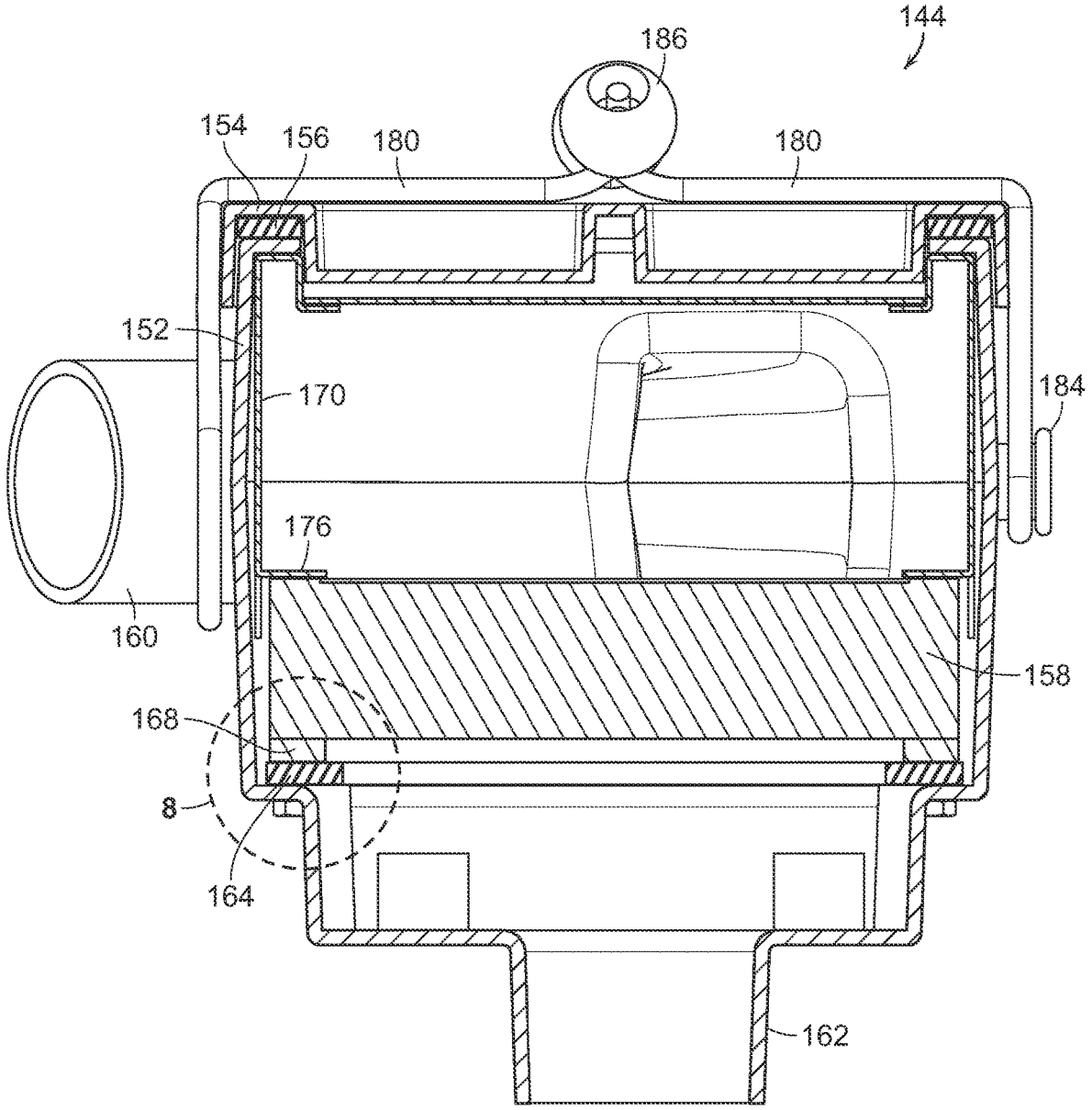
FIG. 7 is a cross-sectional view of a filter assembly used in accordance with the present invention.
Figure 8:
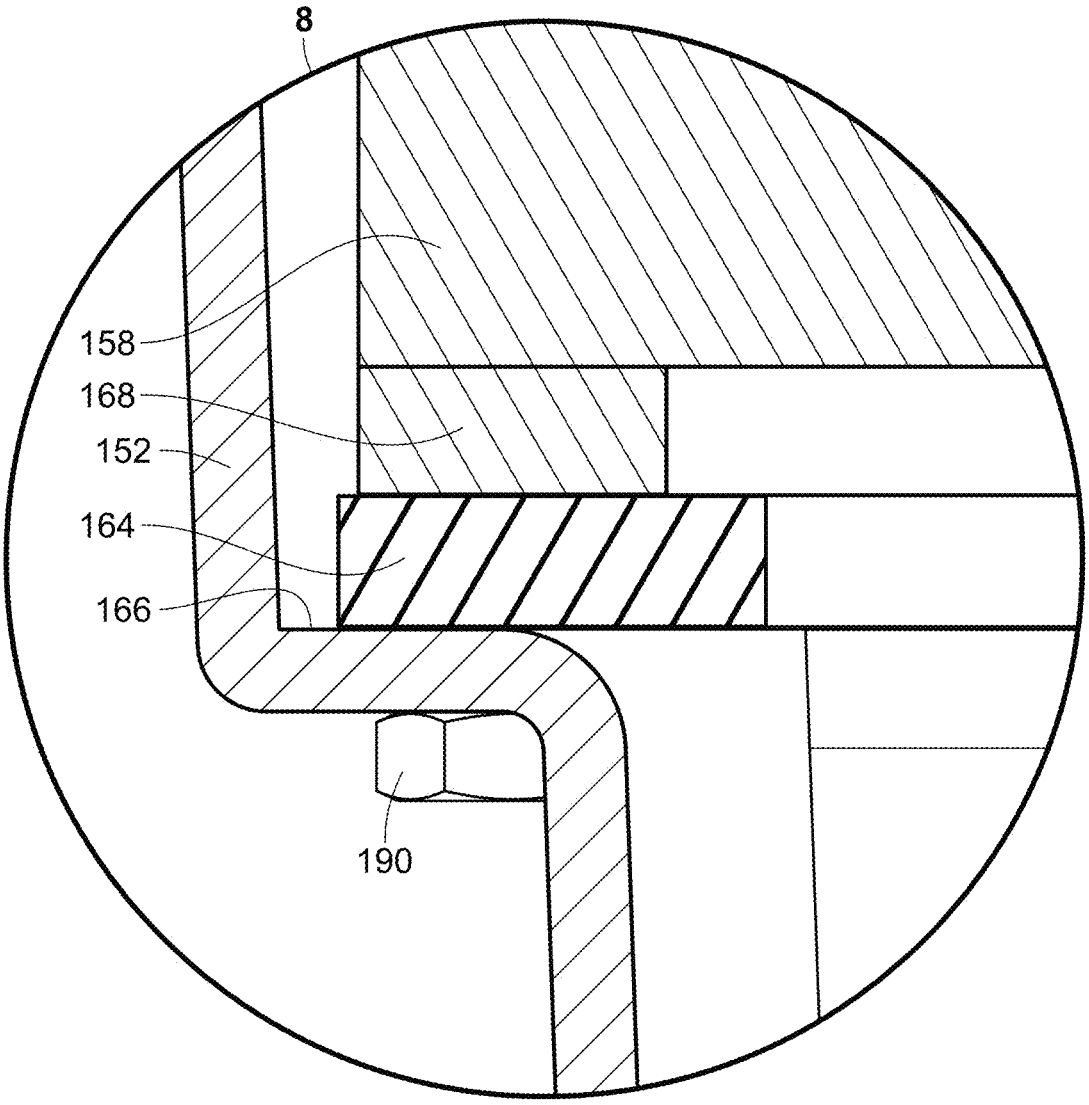
FIG. 8 is an enlarged cross-sectional view of area "8" of FIG. 7.

While the lid 154 may be attached to the base 152 of the box 150 by a variety of means, in a particularly preferred embodiment, as illustrated, straps 180 are used to compressively connect the lid 154 to the base 152 of the box 150. The straps are comprised of a material which can accomplish such a compressive connection, such as rubber, bungee material, or other elastomeric material. In the illustrated embodiment, a loop end 182 of the straps 180 are positioned over and attached to lid strap anchors 184 extending from the base 152 of the box 150. At the opposite end 186 of the strap 180 may be formed a manual grip for manually gripping the end 186 of the strap and extending it over the lid 154 of the box 150 for coupling to a strap 180 from an opposite side of the box, as illustrated in FIGS. 3 and 7. In this manner, the straps securely fasten the lid 154 to the base 152 of the box, and do so in a compressive manner, sealing the box 150. However, an operator is able to quickly and easily manually remove the straps 180, which allows the lid 154 to be removed without the use of tools. This adds great convenience when it is necessary to replace the internal filter 158.

In use, as the floor cleaning device 100 is in operation, air to be exhausted, such as from the vacuum generator motor or blower, is piped into the filter assembly 144 through the exhaust inlet 148. The exhaust air then passes through the filter 158, after which the filtered air passes through to the exhaust outlet 162, where it can then be safely emitted. As mentioned above, using a HEPA or HEPA-type or like filter enables the filtration of nearly all contaminants from the air, including vaporized bodily fluids, mold, bacteria, viruses and the like which could be harmful to breathe or otherwise contaminate other areas of the room or building if it were not for the incorporation of the filter assembly 144 of the present invention.

Although several embodiments have been described in detail for purposes of illustration, various modifications may be made without departing from the scope and spirit of the invention. Accordingly, the invention is not to be limited, except as by the appended claims.

What is claimed is:

1. A floor cleaning device, comprising:

a floor cleaning member having a cleaning solution emitter for emitting cleaning solution onto a floor and an inlet through which debris and dirty cleaning solution is suctioned;

a cleaning solution tank fluidly coupled to the cleaning solution emitter of the floor cleaning member;

a fluid debris tank fluidly coupled to the inlet of the floor cleaning member for receiving debris and dirty cleaning solution therein;

a vacuum generator that creates a vacuum in the fluid debris tank; and a filter assembly, including an air filter that filters object of a micron or larger in size, disposed between the fluid debris tank and an exhaust air outlet, that filters exhaust air of the of the fluid debris tank;

wherein the filter assembly includes an enclosed box having an inlet in fluid communication with the fluid debris tank and an outlet in fluid communication with or defining the exhaust air outlet:

wherein the filter is disposed within the box intermediate the inlet and outlet thereof, and pressed against a sealing plate disposed between the filter and the box to form an airtight seal between the filter and the sealing plate.

2. The floor cleaning device of claim 1, wherein the floor cleaning member comprises a manually operated wand.

3. The floor cleaning device of claim 2, wherein a cleaning solution hose extends from the cleaning solution tank to the cleaning solution emitter of the wand.

4. The floor cleaning device of claim 2, including a vacuum hose extending from the fluid debris tank to the wand.

5. The floor cleaning device of claim 1, including a pump that pumps cleaning solution from the cleaning solution tank to the cleaning solution emitter of the floor cleaning member.

6. The floor cleaning device of claim 1, including a wheeled base enabling manual movement of the floor cleaning device from one floor area to another.

7. The floor cleaning device of claim 1, wherein the filter removes at least 99% of particles 0.3 microns or greater in size.

8. The floor cleaning device of claim 1, wherein the box includes a lid and a base with a gasket therebetween to create an airtight seal.

9. The floor cleaning device of claim 8, including a connector that compresses the gasket as the lid is connected to the base.

10. The floor cleaning device of claim 9, wherein the connector comprises resilient straps extending between the lid and the base to form an airtight seal therebetween.

11. The floor cleaning device of claim 1, including at least one retainer plate disposed between the lid and the filter that presses the filter against the sealing plate.

12. A floor cleaning device, comprising:

a floor cleaning member comprising a manually operated wand having a cleaning solution emitter for emitting cleaning solution onto a floor and an inlet through which debris and dirty cleaning solution is suctioned;

a cleaning solution tank fluidly coupled to the cleaning solution emitter of the floor cleaning member;

a cleaning solution hose extends from the cleaning solution tank to the cleaning solution emitter of the wand;

a pump that pumps cleaning solution from the cleaning solution tank to the cleaning solution emitter of the floor cleaning member;

a fluid debris tank fluidly coupled to the inlet of the floor cleaning member for receiving debris and dirty cleaning solution therein;

a vacuum hose extending from the fluid debris tank to the wand;

a vacuum generator that creates a vacuum in the fluid debris tank; and a filter assembly, including an enclosed box having an inlet in fluid communication with the fluid debris tank and an outlet in fluid communication with or defining an exhaust air outlet, and an air filter disposed in the box intermediate the inlet and outlet that filters objects a micron or larger in size from the exhaust air of the fluid debris tank;

wherein the filter is disposed within the box intermediate the inlet and outlet thereof, and pressed against a sealing plate disposed between the filter and the box to form an airtight seal between the filter and the sealing plate.

13. The floor cleaning device of claim 12, including a wheeled base enabling manual movement of the floor cleaning device from one floor area to another.

14. The floor cleaning device of claim 12, wherein the filter removes at least 99% of particles 0.3 microns or greater in size.

15. The floor cleaning device of claim 12, wherein the box includes a lid and a base with a gasket therebetween to create an airtight seal.

16. The floor cleaning device of claim 15, including connectors extending between the lid and the base that compressively hold the lid onto the base.

17. The floor cleaning device of claim 16, wherein the connectors comprise resilient straps.

18. The floor cleaning device of claim 15, including at least one retainer plate disposed between the lid and the filter that presses the filter against the sealing plate.

19. A floor cleaning device, comprising:

a floor cleaning member comprising a manually operated wand having a cleaning solution emitter for emitting cleaning solution onto a floor and an inlet through which debris and dirty cleaning solution is suctioned;

a cleaning solution tank fluidly coupled to the cleaning solution emitter of the floor cleaning member;

a cleaning solution hose extends from the cleaning solution tank to the cleaning solution emitter of the wand;

a pump that pumps cleaning solution from the cleaning solution tank to the cleaning solution emitter of the floor cleaning member;

a fluid debris tank fluidly coupled to the inlet of the floor cleaning member for receiving debris and dirty cleaning solution therein;

a vacuum hose extending from the fluid debris tank to the wand;

a vacuum generator that creates a vacuum in the fluid debris tank; and a filter assembly, including an enclosed box having an inlet in fluid communication with the fluid debris tank and an outlet in fluid communication with or defining an exhaust air outlet, and an air filter disposed in the box intermediate the inlet and outlet that filters at least 99% of objects 0.3 microns or larger in size from the exhaust air of the fluid debris tank;

wherein the box includes a lid and a base with a gasket therebetween and connectors that compress the gasket as the lid is connected to the base to form an airtight seal therebetween;

wherein the filter is disposed within the box intermediate the inlet and outlet thereof in contact with a sealing plate; and wherein at least one retainer plate disposed between the lid and the filter presses the filter against the sealing plate to form an airtight seal between the filter and the sealing plate as the lid is attached to the base.

20. The floor cleaning device of claim 19, wherein the connectors comprise resilient straps.

* * * * *